United States Patent [19]

Färber et al.

[11] Patent Number: 5,000,375

[45] Date of Patent: Mar. 19, 1991

[54] PARALLELEPIPEDAL PACKAGE, ESPECIALLY ONE MADE OF A COMPOSITE OF CARDBOARD AND PLASTIC, FOR LIQUIDS, SOUPS, AND SIMILAR PRODUCTS, AND METHOD OF MANUFACTURE

[75] Inventors: Jürgen Färber, Kaarst; Matthias Dammers, Alsdorf; Klaus O. K. Kamin, Düsseldorf, all of Fed. Rep. of Germany

[73] Assignee: PKL Verpackungssysteme GmbH, Dusseldorf, Fed. Rep. of Germany

[21] Appl. No.: 416,568

[22] Filed: Oct. 3, 1989

[30] Foreign Application Priority Data

Oct. 18, 1988 [DE] Fed. Rep. of Germany ..... 3835390

[51] Int. Cl.[5] ..... B65D 5/46

[52] U.S. Cl. ..... 229/117.12; 229/8

[58] Field of Search ..... 229/8, 117.09, 117.12, 229/631.2, 631.3, 125.42

[56] References Cited

U.S. PATENT DOCUMENTS

| | | | |
|---|---|---|---|
| 2,050,894 | 8/1936 | Paige | 229/8 |
| 2,884,181 | 4/1959 | McCormick | 229/8 |
| 3,369,727 | 2/1968 | Wright | 229/8 |
| 3,390,827 | 7/1968 | Malby et al. | 229/117.12 |
| 3,390,828 | 7/1968 | Malby et al. | 229/117.12 |
| 3,628,719 | 12/1971 | Ford, Sr. | 229/117.12 |
| 4,313,556 | 2/1982 | Boyle et al. | 229/8 |
| 4,327,861 | 5/1982 | Thompson | 229/117.12 |
| 4,846,396 | 7/1989 | Palazzolo | 229/125.42 |

FOREIGN PATENT DOCUMENTS

| | | | |
|---|---|---|---|
| 105691 | 1/1967 | Denmark | 229/117.12 |
| 1215576 | 4/1966 | Fed. Rep. of Germany | . |
| 2305538 | 8/1973 | Fed. Rep. of Germany | 229/8 |
| 1463154 | 12/1966 | France | 229/8 |

*Primary Examiner*—Gary E. Elkins

*Attorney, Agent, or Firm*—Sprung Horn Kramer & Woods

[57] ABSTRACT

A parallelepipedal package, especially one made of a composite of cardboard and plastic, for liquids, soups, and similar products, with a front wall, a rear wall, and two side walls, with a square or rectangular top wall and a square or rectangular bottom wall, and with its edges drawn in to create at least one convex area. The drawn-in edges of the package extend over an area located strictly at the top of the otherwise still parallelepipedal package.

11 Claims, 4 Drawing Sheets

PARALLELEPIPEDAL PACKAGE, ESPECIALLY ONE MADE OF A COMPOSITE OF CARDBOARD AND PLASTIC, FOR LIQUIDS, SOUPS, AND SIMILAR PRODUCTS, AND METHOD OF MANUFACTURE

BACKGROUND OF THE INVENTION

The invention concerns a parallelepipedal package, especially one made of a composite of cardboard and plastic, for liquids, soups, and similar products, with a front wall 1, a rear wall 2, and two side walls 3 and 4, with a square or rectangular top wall 5 and a square or rectangular bottom wall 6, and with its edges 14 and 15 drawn in to create at least one convex area.

A parallelepipedal package of this type is known from German Patent 1 215 576. The point of departure for the known package is the realization that, when it is made out of a relatively thin material in a parallelepipedal shaping cell, it tends to buckle out at the bottom and collapse at the top. The buckling out at the bottom is due to the weight of the product in the package, and the collapse at the top derives from the package being so tightly welded that the bottom draws the top in when it buckles. Packages in this condition are unattractive and are not strong enough to resist squeezing. The aforesaid German patent accordingly proposes making the side walls of the package slightly convex and drawing the longitudinal edges in while keeping the top and bottom walls precisely rectangular in order to plump the package out from top to bottom and make it strong enough to resist squeezing, whereby the perimeter of the package will remain constant in all horizontal sections. This approach accordingly involves consciously exhausting the deformation potential of the packaging material from the very beginning within limits dictated by the dimensional stability of the top and bottom walls due to the slight convexity at the top and bottom of the side walls of the package to the extent that further buckling at the bottom and hence drawing in of the side walls at the top will no longer be possible because it will be counteracted by the volume of the product at the top of the package slightly exceeding that of the parallelepiped.

OBJECT OF THE INVENTION

The object of the present invention is to provide a parallelepipedal package, especially one made of a composite of cardboard and plastic, that will be attractive, distinguished by even better stability, and even easier to hold and handle.

This object is attained in accordance with the invention by the improvement wherein the drawn-in edges of the package extend over an area located strictly at the top of the otherwise still parallelepipedal package. The result is a package with a bottom that remains precisely parallelepipedal, allowing for existing and permissible tolerances, and it is the shape of only the top of the package that changes. The package is accordingly provided with a characteristic and attractive appearance, and the exact same tool can be employed to shape the bottom of the package. The skillful displacement of the drawn-in edges of the package to a more practical area, specifically the top, by for example allowing the drawn-in edges to extend to the top wall, makes the package much easier to hold. This is also true when the area of the package that includes the drawn-in edges is between an upper area 13 adjacent to the top wall and a lower area 12 adjacent to the bottom wall, with both areas essentially remaining parallelepipedal. In either case it has been proven practical for the drawn-in edges to consist of depressions 16 and 17 in the front and rear walls that extend over the width of the package. This measure will decrease the depth of the area of the package that is held, to the extent of the depression, which is at least as wide as a finger, making it easy for even a child to hold. This is especially helpful with plastic-coated packages that are refrigerated. Condensation makes them slippery.

The invention also of course covers a package with drawn-in edges that consist of depressions 19, 21, 23, and 24 introduced into its side walls and extending over its depth. These depressions are preferably concave, have a uniform cross-section, and are demarcated in a practical way by folds, scores, and similar structures that essentially parallel the top and bottom walls. It turns out to be practical for the bottom fold or score 11 to be about half-way up the package. When the depressed area is about $\frac{1}{3}$ to $\frac{1}{4}$ as high as the overall package, the depression can be approximately 10 to 20% and preferably 15% as deep as it is high.

Packages of this type will not buckle when held in the hand, but will have a stable shape because, whether the depressions are in the front and rear walls or in the side walls, perpendicular pressure will always be exerted on whatever wall is at a right angle to the side with the depression when the package is held in the hand. The stable shape also improves handling, when the product is poured out for example.

Stability will be even higher when the inner layers of the side walls and or the front and rear walls are always fastened together—welded, cemented, etc. for example—in the vicinity of the drawn-in edges, preferably at the deepest point of the depressions.

Packages in accordance with the invention can, due to their characteristic shape, be employed for such special products as special and special-purpose milk or particular fruit juices with pieces of fruit, products in other words that are to be especially featured. They can also accommodate products that can be heated in the package, by microwaves for example. Even a package that has been heated in this way can comfortably be held at the drawn-in longitudinal edges without injury because only a narrow area at the edge comes into contact with the fingers.

Three methods of manufacturing such a parallelepipedal package, especially one made of a composite of cardboard and plastic, for liquids, soups, and similar products under aseptic conditions are conceivable.

One method consists of the steps of 1. scoring the blank,
2. sealing the longitudinal seam,
3. shaping the package up,
4. folding and sealing the bottom,
5. prefolding the peak and depressed area or areas,
6. optionally sterilizing the inner surfaces,
7. final-shaping and securing the depressions,
8. filling the package, and
9. sealing the package.

In this method, which is especially appropriate for shaping a package out of a blank or jacket, the depressions are shaped and secured before the package is finally sealed.

The second method consists of the steps of 1. scoring the web or blank, 2. sealing the longitudinal seam,
3. shaping the package,
4. sealing the bottom,
5. optionally sterilizing the package,
6. filling the package,
7. sealing the package, and
8. shaping the package and securing the depressions.

In this method the depressions are not shaped and secured until the package has been finally sealed. The method is especially appropriate for manufacturing packages from reels of material.

It is practical to shape the depressions by applying pressure to the package from above, forcing the area in with a tool, and finally sealing the vicinity of the corners in the depressed area by ultrasound, high frequency, pulsed heat etc., or in conjunction with the first method cementing by the hot-melt process.

As an alternative to the first method, the package can be shaped after filling with specially designed depression impressers and secured in the vicinity of the depressions by the product itself, which is especially appropriate when the packages are manufactured from the web.

BRIEF DESCRIPTION OF THE DRAWINGS

Preferred embodiments of the invention will now be described in detail with reference to the drawings, wherein.

DETAILED DESCRIPTION OF THE INVENTION

Figure 1:
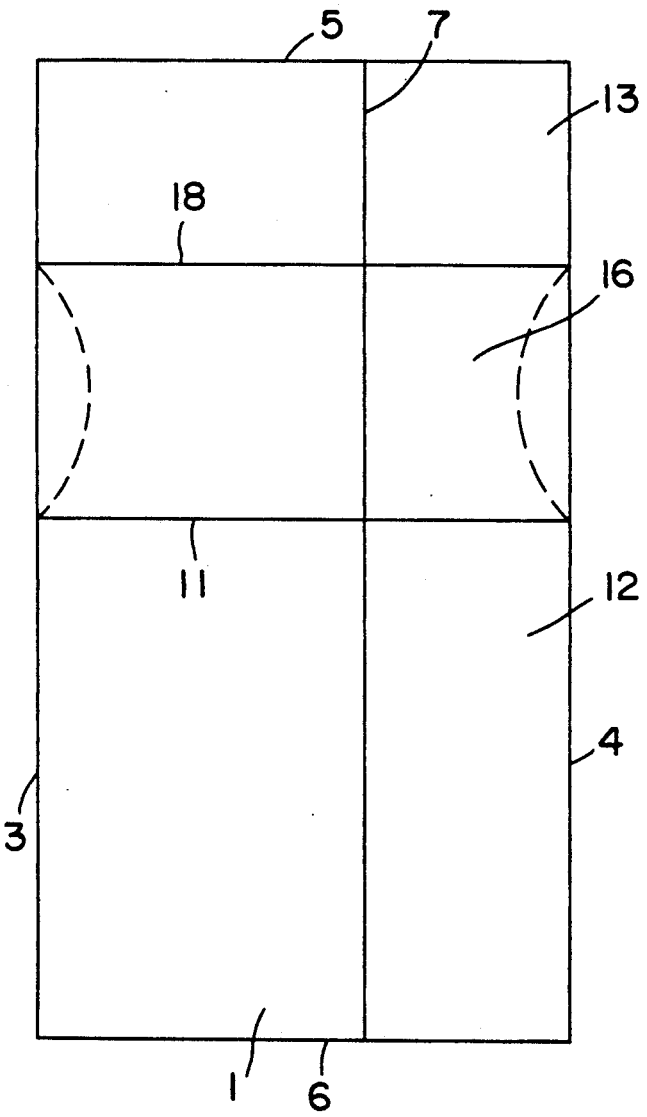
FIGS. 1 and 2 illustrate one embodiment of a parallelepipedal package with depressions in its front and rear walls.
Figure 2:
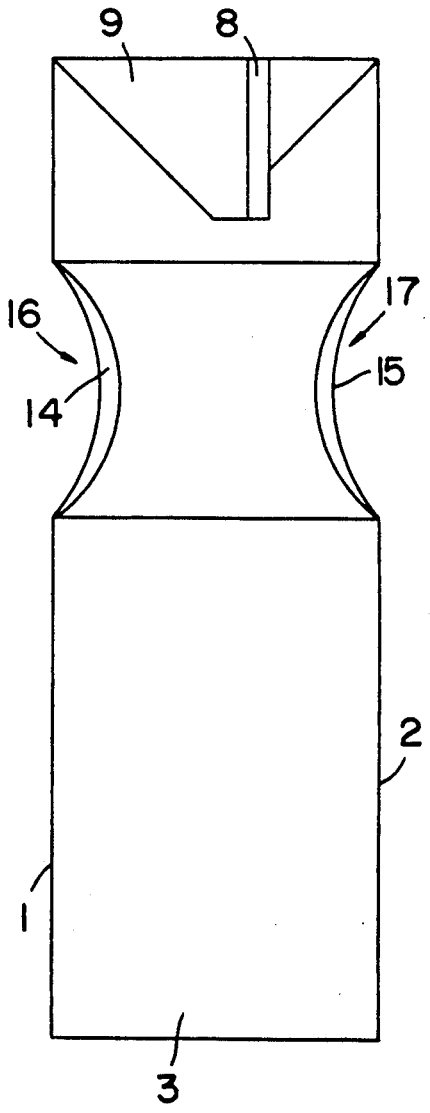

The package illustrated in FIGS. 1 and 2 is made of a composite of cardboard and plastic and is intended to accommodate liquids, soups, and similar products. It has a front wall 1, a rear wall 2, and two side walls 3 and 4 and a top wall 5 and bottom wall 6. The package has been manufactured from a blank and is secured together at the rear by a longitudinal seam 7. Unillustrated tabs are tightly secured together at the bottom. At the top of the package is a ridged seam 8 with flaps 9, only one of which is illustrated in FIG. 2, that are applied to side walls 3 and 4.

The package is divided by a fold or score 11 more or less at the midsection into a lower parallelepipedal area 12 and an upper and also parallelepipedal area 13. Between the upper and lower areas extends an area with drawn-in edges 14 and 15 that consist in the illustrated embodiment of depressions 16 and 17 on front wall 1 and on rear wall 2. Each concave depression extends from lower fold 11 to an upper fold 18. The distance between lower fold 11 and upper fold 18 is at least the width of a finger. Since depressions 16 and 17 decrease the depth of the package in this area, it is easy to hold. The projecting longitudinal edges also make it possible to hold the package in the vicinity of drawn-in edges 14 and 15, which is of particular advantage when the package is hot, from microwaves for example. The layers of the package are fastened together inside in the vicinity of the longitudinal edges, by externally applied heat (ultrasound or high frequency) or by applying hot-melt dots to the inner surface in the vicinity of the deepest points of the depressions. This measure provides the package with a stable shape, making it easy to handle even when open as the result of the specially designed holding area.

Figure 3:
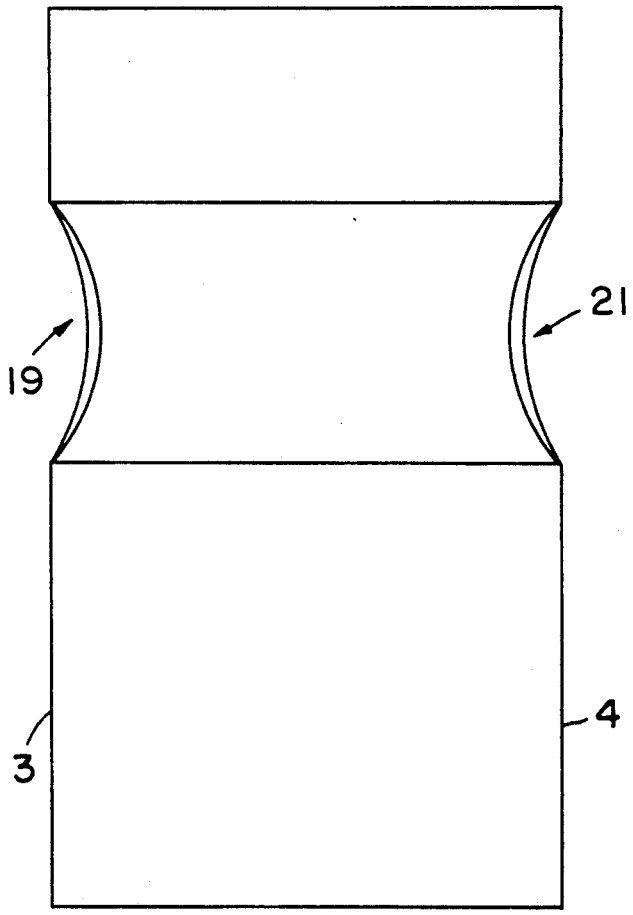
FIGS. 3 and 4 illustrate a similar parallelepipedal package with depressions in each side wall.
Figure 4:
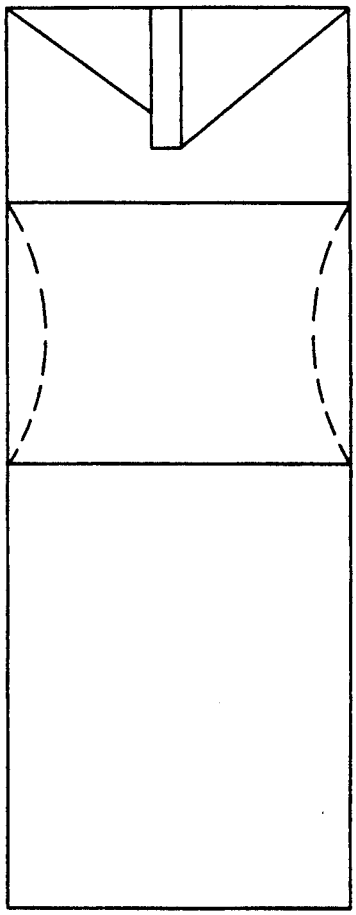

The package illustrated in FIGS. 3 and 4 is identical in principle except that its depressions 19 and 21 are in side walls 3 and 4.

Figure 5:
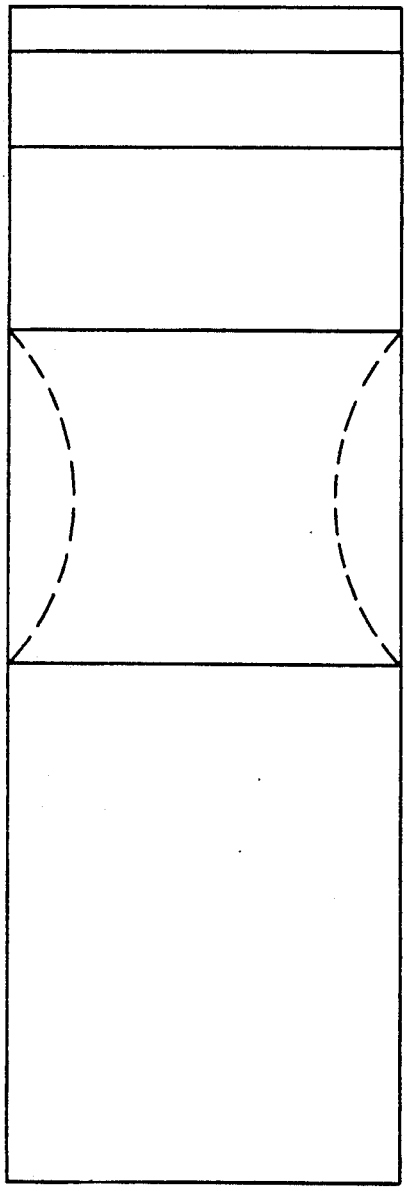
FIGS. 5 and 6 illustrate a similar package with a square cross-section, and FIGS. 7 and 8 relate to an embodiment wherein the area that includes the drawn-in edges extends to the top wall.
Figure 6:
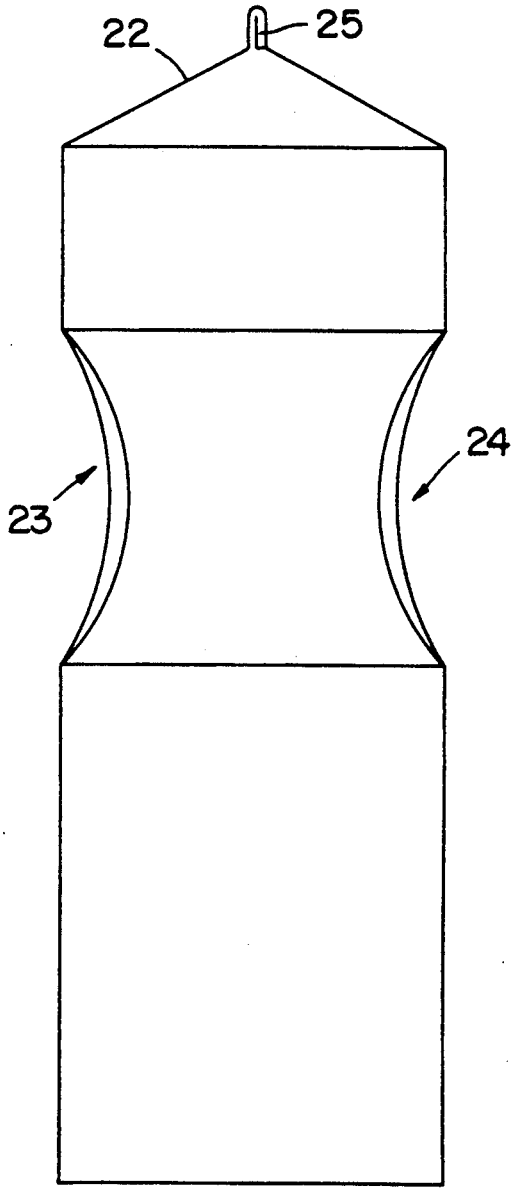
Figure 7:
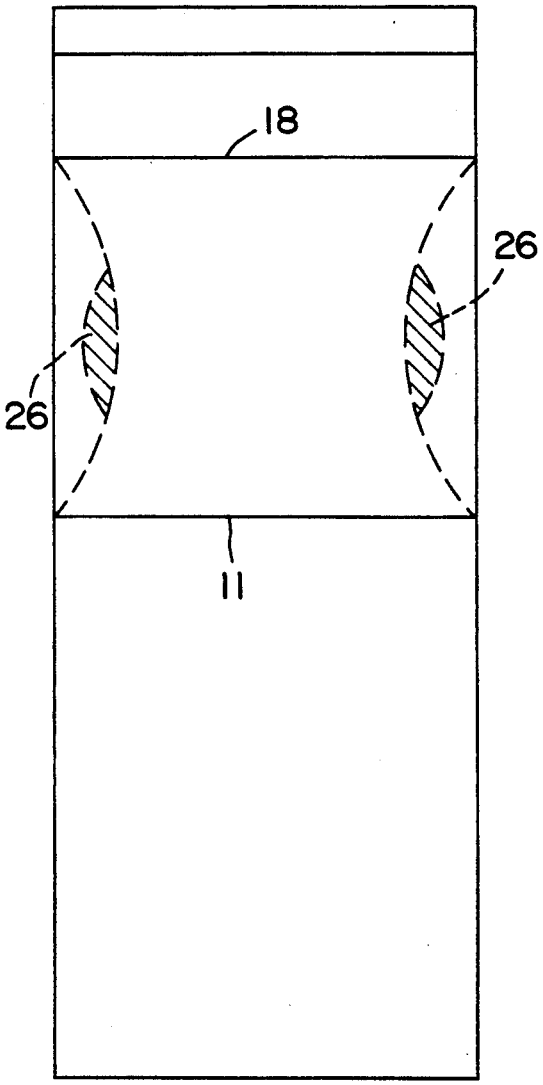
Figure 8:
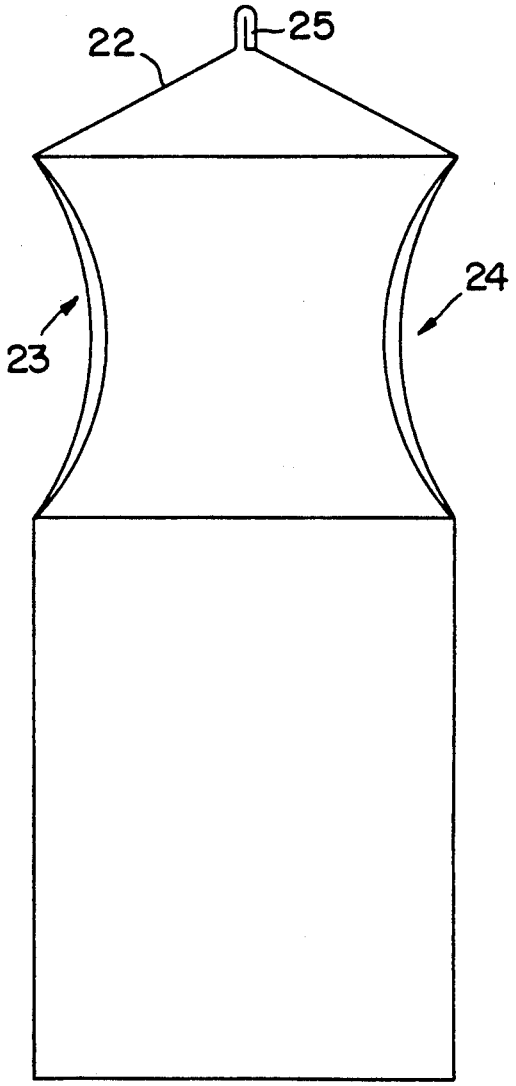

Still another variation is represented by the package with the peaked top 22 illustrated in FIGS. 5 and 6. Its depressions 23 and 24 parallel the ridged seam 25 in the peaked-top package.

The package can be manufactured by scoring the blank, folding up the various areas, and sealing the longitudinal seam to obtain a jacket that is then preliminary folded at the bottom and finally sealed to ensure that the bottom is tight. The peak and depressed area or areas are then prefolded and the depressions finally shaped and "secured" by for example forcing the depressions in from outside and securing the drawn-in longitudinal edges either by sealing the inner layers of the overlapping walls or by means of hot-melt dots applied inside. The package is then filled and the peak sealed. When sterilization is necessary for a particular type of product, it can be carried out conventionally before the depressions are final-shaped and secured.

It is on the other hand to be understood that the invention can be varied within the scope of the claims. The depressions can for example also naturally extend at an angle to the ridged seam 25 in the peaked package. Furthermore, the depressions can extend as far as top wall 5, in which case the lower score will for practical purposes be higher. There can also be basically only one depression.

It is understood that the specification and examples are illustrative but not limitative of the present invention and that other embodiments within the spirit and scope of the invention will suggest themselves to those skilled in the art.

What is claimed is:

1. In a parallelepipedal package having a front wall, a rear wall, two side walls, a square or rectangular top wall and a square or rectangular bottom wall, and with edges drawn in to create at least one convex area, the improvement wherein the drawn-in edges of the package extend to the top wall.

2. A package according to claim 1, wherein the drawn-in edges consist of depressions in the front and rear walls that extend over the width of the package.

3. A package according to claim 1, wherein the drawn-in edges consist of depressions introduced into the side walls and extending over their depth.

4. A package according to claim 1, wherein the depressions are demarcated by folds that essentially parallel the top and bottom walls.

5. A package according to claim 4, wherein the bottom fold or score is about half-way up the package.

6. A package according to claim 1, wherein the drawn-in area is about $\frac{1}{3}$ to $\frac{1}{4}$ as high as the overall package.

7. A package according to claim 1, wherein the drawn-in area is approximately 10 to 20% as deep as it is high.

8. A package according to claim 1, wherein the drawn-in area is approximately 15% as deep as it is high.

9. A package according to claim 1, wherein inner faces of the side walls or of the front and rear walls are fastened together in the vicinity of the drawn-in edges, adjacent the deepest points of the drawn-in area.

10. A package according to claim 1, made of cardboard or plastic and filled with a liquid.

11. A package according to claim 1, wherein the depressions are demarcated by scores that essentially parallel the top and bottom walls.

* * * * *